US009284633B2

(12) United States Patent
Yamada et al.

(10) Patent No.: US 9,284,633 B2
(45) Date of Patent: Mar. 15, 2016

(54) HEAT RESISTANT CAST STEEL, MANUFACTURING METHOD THEREOF, CAST PARTS OF STEAM TURBINE, AND MANUFACTURING METHOD OF CAST PARTS OF STEAM TURBINE

(75) Inventors: Masayuki Yamada, Yokohama (JP); Reki Takaku, Yokohama (JP); Haruki Ohnishi, Yokohama (JP); Kenichi Okuno, Yokohama (JP); Kenichi Imai, Yokohama (JP); Shinji Tanaka, Muroran (JP); Kazuhiro Miki, Muroran (JP)

(73) Assignees: KABUSHIKI KAISHA TOSHIBA, Tokyo (JP); THE JAPAN STEEL WORKS, LTD., Tokyo (JP)

( * ) Notice: Subject to any disclaimer, the term of this patent is extended or adjusted under 35 U.S.C. 154(b) by 20 days.

(21) Appl. No.: 13/336,402

(22) Filed: Dec. 23, 2011

(65) Prior Publication Data

US 2012/0160376 A1 Jun. 28, 2012

(30) Foreign Application Priority Data

Dec. 28, 2010 (JP) ..... P2010-293315

(51) Int. Cl.
*C21D 8/00* (2006.01)
*C22C 38/02* (2006.01)
(Continued)

(52) U.S. Cl.
CPC . *C22C 38/02* (2013.01); *C21D 1/26* (2013.01); *C21D 1/28* (2013.01); *C21D 6/002* (2013.01);
(Continued)

(58) Field of Classification Search
CPC ..... C21D 1/26; C21D 1/28; C21D 6/00; C22C 38/00
USPC ..... 148/542, 325, 330, 548; 420/38, 64, 420/68–70, 106–114, 119, 121–128
See application file for complete search history.

(56) References Cited

U.S. PATENT DOCUMENTS 5,911,842 A 6/1999 Shiga et al.
6,358,004 B1 * 3/2002 Shiga et al. ..... 415/200
(Continued)

FOREIGN PATENT DOCUMENTS

EP 0 806 490 A1 11/1997
EP 1 849 881 A2 10/2007
(Continued)

OTHER PUBLICATIONS

H. Chandler, Heat Treaters Guide: Practices and Procedures for Irons and Steels, 2nd ed., ASM International, 1995., pp. 2.*
(Continued)

*Primary Examiner* — Jie Yang
(74) *Attorney, Agent, or Firm* — Oblon, McClelland, Maier & Neustadt, L.L.P.

(57) ABSTRACT

A heat resistant cast steel containing, in mass %, C: 0.05-0.15, Si: 0.03-0.2, Mn: 0.1-1.5, Ni: 0.1-1, Cr: 8-10.5, Mo: 0.2-1.5, V: 0.1-0.3, Co: 0.1-5, W: 0.1-5, N: 0.005-0.03, Nb: 0.01-0.2, B: 0.002-0.015, Ti: 0.01-0.1, Fe and unavoidable impurities. A method for manufacturing a heat resistant cast steel, the method including melting raw materials to obtain a molten metal, refining and degassing the molten metal, pouring the molten metal into a predetermined mold to form a shape, performing an annealing treatment at a temperature of 1000 to 1150° C., performing a normalizing treatment at a temperature of 1000 to 1200° C., performing a first stage tempering treatment at a temperature of 500 to 700° C., and performing a second stage tempering treatment at a temperature of 700 to 780° C.

4 Claims, 1 Drawing Sheet

(51) Int. Cl.

| | |
|---|---|
| ***C21D 1/26*** | (2006.01) |
| ***C21D 1/28*** | (2006.01) |
| ***C21D 6/00*** | (2006.01) |
| ***C22C 38/00*** | (2006.01) |
| ***C22C 38/04*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| *C21D 9/00* | (2006.01) |
| *C21D 9/50* | (2006.01) |

(52) U.S. Cl.

CPC ..... *C22C 38/001* (2013.01); *C22C 38/04* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 9/0068* (2013.01); *C21D 9/50* (2013.01); *C21D 2211/001* (2013.01); *C21D 2211/004* (2013.01); *C21D 2211/008* (2013.01)

(56) References Cited

U.S. PATENT DOCUMENTS

| | | | | |
|---|---|---|---|---|
| 7,238,005 | B2 | 7/2007 | Takahashi et al. | |
| 7,850,424 | B2 | 12/2010 | Takahashi et al. | |
| 2007/0071599 | A1* | 3/2007 | Arai et al. | 415/200 |
| 2007/0253811 | A1 | 11/2007 | Suga et al. | |

FOREIGN PATENT DOCUMENTS

| | | | | |
|---|---|---|---|---|
| JP | 8-333657 | | 12/1996 | |
| JP | 08-333657 | * | 12/1996 | C22C 38/00 |
| JP | 2005-060826 | A | 3/2005 | |
| JP | 3723924 | | 9/2005 | |
| JP | 2009293063 | A * | 12/2009 | |

OTHER PUBLICATIONS

ASM Handbook, vol. 4: Heat Treating, ASM Hanbook Committee, 1991, pp. 35-36, 121.*

English abstract of JP2009293063A, Dec. 17, 2009.*

"Method for Charpy pendulum impact test of metallic materials", JIS Z 2242 (Japanese Industrial Standard), (JISF/JSA), 2005, 23 pages.

"Metallic materials-Uniaxial creep testing in tension-Method of test", JIS Z 2271, (Japanese Industrial Standard), (JISF), 2010, 54 pages.

The Extended European Search Report issued May 16, 2012, in Application No. / Patent No. 11195761.9-2122

Office Action issued in corresponding Japanese patent application No. 2010-293315 dated Feb. 25, 2014 (with English language translation).

* cited by examiner

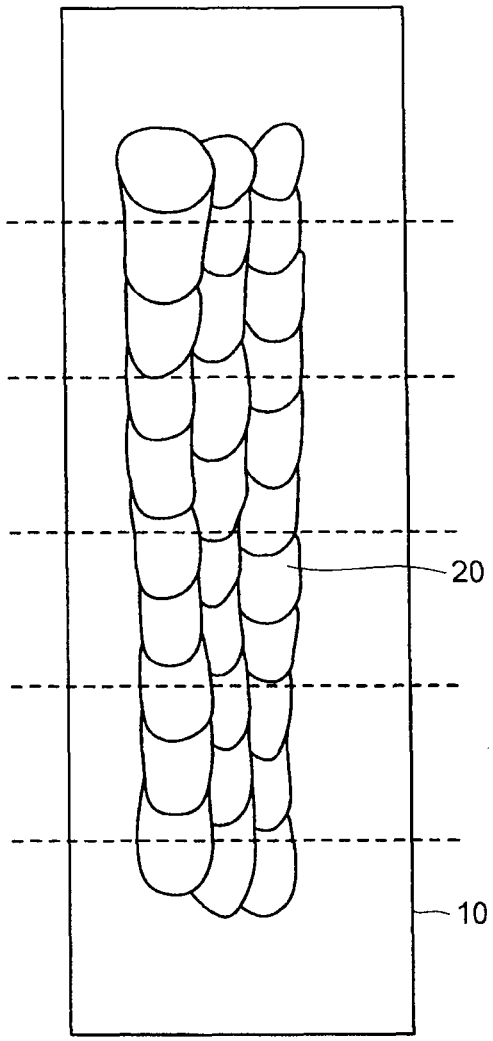
20
10

HEAT RESISTANT CAST STEEL, MANUFACTURING METHOD THEREOF, CAST PARTS OF STEAM TURBINE, AND MANUFACTURING METHOD OF CAST PARTS OF STEAM TURBINE

CROSS-REFERENCE TO RELATED APPLICATIONS

This application is based upon and claims the benefit of priority from Japanese Patent Application No. 2010-293315, filed on Dec. 28, 2010; the entire contents of which are incorporated herein by reference.

FIELD

Embodiments described herein relate generally to a heat resistant cast steel, a manufacturing method thereof, a cast part of a steam turbine made of the heat resistant cast steel, and a manufacturing method of the cast part.

BACKGROUND

The thermal power system tends to raise the steam temperature of a steam turbine in order to make the generating efficiency much higher. As a result, high temperature characteristics demanded for the cast steel material to be used for the steam turbine also become much stricter.

There have been proposed many heat resistant cast steels as cast steel materials to be used for steam turbines.

It is necessary to improve a long creep rupture life of a heat resistant cast steel material which is used for the steam turbine in order to contribute to further improvement of the generating efficiency. In a case where a large cast material such as a turbine casing or a high temperature valve casing of the steam turbine is configured, it is especially required that the heat resistant cast steel material has good quality. Specifically, the heat resistant cast steel material is required that the molten metal has excellent fluidity when casting, cast defects such as gas holes, shrinkage cavities, and hot tears are not many, and component segregation at each portion of the material is not large. If a cast defect occurs, that portion is repaired by welding, so that the heat resistant cast steel material used for the steam turbine is also required to have excellent weldability.

Factors which influence the quality of cast parts include a casting method, chemical component elements of the material configuring the cast parts, and the like. Therefore, it is necessary to select optimum chemical component elements of material in conformity with the cast parts to be produced.

In addition, the heat resistant cast steel material used for the steam turbine is required to have characteristics excellent in the creep rupture life and also in creep ductility and toughness from a viewpoint of the fracture prevention during the operation of the steam turbine. And, when the heat resistant cast steel is subjected to a long aging process at a high temperature or long creep degradation, creep rupture ductility and toughness might be reduced. When such reduction occurs in a large structural component such as a turbine casing or a high temperature valve, an operational risk increases.

Therefore, it is important to provide a product having high reliability for a long term for the heat resistant cast steel material to be used for the steam turbine considering the reduction in strength, ductility and toughness due to aging deterioration of the material.

It is very difficult to achieve all of the above-described improvements of a long creep rupture life, creep rupture ductility and toughness, and also suppression of aging deterioration after a high temperature long-term operation.

BRIEF DESCRIPTION OF THE DRAWING

FIG. 1 is a plan view of a flat plate used in a weldability test.

DETAILED DESCRIPTION

According to an embodiment of the invention, the inventors have made a devoted study in order to achieve (1) improvement of a long creep rupture life, (2) improvement of creep rupture ductility and toughness and (3) suppression of aging deterioration due to a high temperature long-term operation of the heat resistant steel which is used for the cast parts of a steam turbine so as to make it possible to provide a high generating efficiency of the thermal power system and to improve a long durability of the steam turbine, and they found that the following are effective.

(1) To improve the long creep rupture life, optimization of a Cr content and a B content which does not form coarse BN is performed.

(2) To improve creep rupture ductility and toughness, optimization of the N content is performed from a viewpoint of suppressing the generation of coarse BN after securing the N content which is effective to improve the creep rupture life by distributed precipitation of fine Nb(C, N) carbonitride.

(3) To suppress aging deterioration after the high temperature long-term operation, optimization of an Mo content is performed.

As described above, the embodiment has obtained a heat resistant cast steel which can achieve the above-described (1) to (3) at the same time by optimizing especially the Mo content, the B content, and the Cr content.

The heat resistant cast steel according to an embodiment of the invention contains in percent by mass C: 0.05-0.15, Si: 0.03-0.2, Mn: 0.1-1.5, Ni: 0.1-1, Cr: 8-10.5, Mo: 0.2-1.5, V: 0.1-0.3, Co: 0.1-5, W: 0.1-5, N: 0.005-0.03, Nb: 0.01-0.2, B: 0.002-0.015, Ti: 0.01-0.1, and a remainder comprising Fe and unavoidable impurities.

The heat resistant cast steel of the embodiment may additionally contain at least one of Ta: 0.01-0.2, Zr: 0.01-0.1 and Re: 0.01-1.5 in percent by mass in the above-described chemical composition.

The reason for limitation of each range of component elements of the above-described heat resistant cast steel of the embodiment is described below. In the following description, % used when the component elements are indicated denotes percent by mass unless otherwise specified.

(1) C (Carbon)

C secures hardenability and promotes martensitic transformation. In addition, C forms an $M_{23}C_6$ type carbide with Fe, Cr, Mo, etc. contained in an alloy or forms an MX type carbonitride with Nb, V, N, etc. to enhance a high temperature creep strength by precipitation strengthening. Therefore, C is an indispensable element. C is an element which contributes to improvement of proof stress and is indispensable for suppressing the generation of δ ferrite. To exert the above effects, it is necessary to contain C in 0.05% or more. Meanwhile, when the C content exceeds 0.15%, aggregation and coarsening of carbide and carbonitride tend to occur readily, and high temperature creep rupture strength is reduced. Therefore, the C content is determined to be 0.05 to 0.15%. For the same reason, it is preferable that the C content is 0.08 to 0.14%. It is more preferable that the C content is 0.10 to 0.13%.

(2) Si (Silicon)

Si is an element effective as a deoxidizing agent for the molten steel and useful to improve the fluidity of the molten metal at the time of casting. To exert these effects, it is necessary to contain Si in 0.03% or more. Meanwhile, when the Si content exceeds 0.2%, segregation increases in a cast product, and temper embrittlement susceptibility increases considerably. And, notch toughness is impaired, a change in precipitate shape is promoted when a high temperature is maintained for a long time, and toughness is deteriorated with time. Therefore, the Si content is determined to be 0.03 to 0.2%. For the same reason, it is preferable that the Si content is 0.05 to 0.17%. It is more preferable that the Si content is 0.10 to 0.15%.

(3) Mn (Manganese)

Mn is an element effective as a deoxidizing agent or a desulfurizing agent at the time of melting and also effective to improve the strength by enhancing hardenability. To exert the above effects, it is necessary to contain Mn in 0.1% or more. Meanwhile, when the Mn content exceeds 1.5%, Mn is bonded with S to form an MnS non-metallic inclusion, so that toughness is reduced and deteriorated with time, and high temperature creep rupture strength is reduced. Therefore, the Mn content is determined to be 0.1 to 1.5%. For the same reason, it is preferable that the Mn content is 0.3 to 1.0%. It is more preferable that the Mn content is 0.4 to 0.6%.

(4) Ni (Nickel)

Ni is an austenite stabilizing element and effective to improve toughness. It is also effective to improve hardenability, to suppress the generation of δ ferrite, and to improve strength and toughness at room temperature. To exert the above effects, it is necessary to contain Ni in 0.1% or more. Meanwhile, when the Ni content exceeds 1%, aggregation and coarsening of carbide and Laves phase are promoted, high temperature creep rupture strength is reduced, and temper brittleness is assisted. Therefore, the Ni content is determined to be 0.1 to 1%. For the same reason, it is preferable that the Ni content is 0.15 to 0.6%. It is more preferable that the Ni content is 0.2 to 0.4%.

(5) Cr (Chromium)

Cr is an element which is essential to enhance oxidation resistance and high temperature corrosion resistance and also to enhance high temperature creep rupture strength by precipitation strengthening by $M_{23}C_6$ type carbide and $M_2X$ type carbonitride. It is necessary to contain the Cr content in 8% or more in order to exert the above effects. Meanwhile, a tensile strength at room temperature and short-time creep rupture strength are enhanced as the Cr content increases, but a long time creep rupture strength tends to decrease. It is also considered to be a cause of an inflection phenomenon of a long creep rupture life. And, when the Cr content increases, a substructure (fine structure) of a martensitic structure is changed notably in a long-time region, and there occurs a progress of deterioration of the fine structure, such as production of sub-grains in the substructure, prominent aggregation or coarsening of the precipitate near the grain boundary, or a significant decrease in dislocation density. Such tendencies are enhanced quickly when the Cr content exceeds 10.5%. Therefore, the Cr content is determined to be 8 to 10.5%. For the same reason, it is preferable that the Cr content is 8.5 to 10.2%, and it is more preferable that the Cr content is 8.7% or more and less than 9.5%.

(6) Mo (Molybdenum)

Mo forms a state of solid-solution in an alloy to reinforce the solid-solution of a matrix. And, Mo generates fine carbide $Mo_2C$ or fine Laves phase $Fe_2(Mo, W)$ to improve a high temperature creep rupture strength. In addition, Mo enhances the resistance to temper softening. Mo is an element which is also effective for suppression of temper embrittlement. The Mo content is required to be 0.2% or more to exert the above effects. Meanwhile, when the Mo content exceeds 1.5%, δ ferrite is generated, toughness is reduced considerably, and a high temperature creep rupture strength is also reduced. Therefore, the Mo content is determined to be 0.2 to 1.5%.

When the fine carbide $Mo_2C$ or the fine Laves phase $Fe_2(Mo, W)$ is heated at a high temperature for a long period, its aggregation and coarsening progress with age, and an effect to improve the high temperature creep rupture strength is reduced. This influence increases when the Mo content is 1% or more. When the Mo content is less than 0.3%, the contained Mo which is effective for improvement of the high temperature creep rupture strength does not contribute so much. Therefore, it is preferable that the Mo content is 0.3 to 1%. Since the above-described effects for improvement of creep rupture strength, improvement of creep rupture ductility and toughness, and suppression of aggregation and coarsening of fine carbide $Mo_2C$ and fine Laves phase $Fe_2(Mo, W)$ with age are prominent when the Mo content is 0.35 to 0.65%, it is more preferable that the Mo content is determined to be 0.35 to 0.65%.

(7) V (Vanadium)

V is an element effective to improve a high temperature creep rupture strength by forming fine carbide and carbonitride. The V content is required to be 0.1% or more to exert the above effect. Meanwhile, when the V content exceeds 0.3%, excessive precipitation and coarsening of carbonitride are caused, and the high temperature creep rupture strength is reduced. Therefore, the V content is determined to be 0.1 to 0.3%. For the same reason, it is preferable that the V content is 0.15 to 0.25%. It is more preferable that the V content is 0.18 to 0.22%.

(8) Co (Cobalt)

Co suppresses toughness from being reduced by suppressing generation of δ ferrite and improves a high temperature tensile strength and a high temperature creep rupture strength by solid-solution strengthening. It is because the addition of Co does not decrease an $Ac_1$ transformation temperature, and the generation of the δ ferrite can be suppressed without decreasing textural stability. To exert the above effects, it is necessary to contain Co in 0.1% or more. Meanwhile, when the Co content exceeds 5%, the ductility and the high temperature creep rupture strength are reduced, and the production cost increases. Therefore, the Co content is determined to be 0.1 to 5%. For the same reason, it is preferable that the Co content is 1.5 to 4.0%. It is more preferable that the Co content is 2.5 to 3.5%.

(9) W (Tungsten)

W suppresses aggregation and coarsening of $M_{23}C_6$ type carbide. W is an element which is effective to reinforce a solid-solution in a matrix by forming in a state of solid-solution in an alloy to cause distributed precipitation of the Laves phase on lath boundary or the like and to improve a high temperature tensile strength and a high temperature creep rupture strength. The above effects are significant when W is added together with Mo. To exert the above effects, it is necessary to contain W in 0.1% or more. Meanwhile, when the W content exceeds 5%, it becomes easy to generate δ ferrite and coarse Laves phase, ductility and toughness are reduced, and the high temperature creep rupture strength is also reduced. Therefore, the W content is determined to be 0.1 to 5%. For the same reason, it is preferable that the W content is 1.5% or more and less than 2.0%. It is more preferable that the W content is 1.6 to 1.9%.

(10) N (nitrogen)

N is bonded with C, Nb, and V to form carbonitride and improves a high temperature creep rupture strength. When the N content is less than 0.005%, a sufficient tensile strength and a high temperature creep rupture strength cannot be obtained. Meanwhile, when the N content exceeds 0.03%, its bonding with B is strong, and nitride of BN is generated. Thus, it becomes difficult to produce a sound steel ingot, and ductility and toughness are reduced. And, the content of the solid-solution B effective for a high temperature creep rupture strength decreases due to precipitation of the BN phase, so that the high temperature creep rupture strength is reduced. Therefore, the N content is determined to be 0.005 to 0.03%. For the same reason, it is preferable that the N content is 0.01 or more and less than 0.025%. It is more preferable that the N content is 0.015 to 0.020%.

(11) Nb (Niobium)

Nb is effective to improve tensile strength at room temperature and forms fine carbide and carbonitride to improve a high temperature creep rupture strength. And, Nb generates fine NbC to promote provision of finer crystal grains and improves toughness. Part of Nb serves to provide an effect of improving the high temperature creep rupture strength by precipitating the MX type carbonitride, which is in complex with the V carbonitride. To exert the above effects, it is necessary to contain Nb in 0.01% or more. Meanwhile, when the Nb content exceeds 0.2%, coarse carbide and carbonitride are precipitated, and ductility and toughness are reduced. Therefore, the Nb content is determined to be 0.01 to 0.2%. For the same reason, it is preferable that the Nb content is 0.02 to 0.12%. It is more preferable that the Nb content is 0.03 to 0.08%.

(12) B (Boron)

B is added in a very small amount to increase hardenability and to improve toughness. B also has an effect to suppress aggregation and coarsening of carbide, carbonitride and Laves phase in martensitic packet, martensitic block, and martensitic lath of austenite grain boundary and its substructure under a high temperature for a long time. In addition, B is an element effective to improve the high temperature creep rupture strength when it is added together with W and Nb. To exert the above effects, it is necessary to contain B in 0.002% or more. But, when the B content exceeds 0.015%, B is bonded with N to precipitate a BN phase, and high temperature creep rupture ductility and toughness are reduced considerably. And, the content of the solid-solution B effective for the high temperature creep rupture strength decreases due to precipitation of the BN phase, so that the high temperature creep rupture strength is reduced, and weldability is deteriorated. Therefore, the B content is determined to be 0.002 to 0.015%. For the same reason, it is preferable that the B content is 0.002 to 0.012%, and it is more preferable that the B content is 0.005 to 0.01%.

(13) Ti (Titanium)

Ti is one of deoxidizing agents and improves high temperature creep rupture strength by generating carbide or nitride. To exert these effects, it is necessary to contain Ti in 0.01% or more. But, when the Ti content exceeds 0.1%, a non-metallic inclusion such as $TiO_2$ is generated in a large amount, and ductility and toughness are reduced. Therefore, the Ti content is determined to be 0.01 to 0.1%. For the same reason, it is preferable that the Ti content is 0.02 to 0.05%.

(14) Ta (Tantalum)

Ta is contained as a selected component because it precipitates fine carbide and improves high temperature creep rupture strength. To exert this effect, it is necessary to contain Ta in 0.01% or more. But, when the Ta content exceeds 0.2%, aggregation and coarsening of carbide are generated, and ductility and toughness are reduced. Therefore, the Ta content is determined to be 0.01 to 0.2%. For the same reason, it is preferable that the Ta content is 0.03 to 0.12%.

(15) Zr (Zirconium)

Zr is contained as a selected component because it has an effect to enhance low temperature toughness. To exert this effect, it is necessary to contain Zr in 0.01% or more. But, when the Zr content exceeds 0.1%, ductility and toughness are reduced. Therefore, the Zr content is determined to be 0.01 to 0.1%. For the same reason, it is preferable that the Zr content is 0.02 to 0.06%.

(16) Re (Rhenium)

Re is contained as a selected component because it forms a solid-solution in a base material to improve a high temperature creep rupture strength by a solid-solution strengthening mechanism. To exert this effect, it is necessary to contain Re in 0.01% or more. But, when the Re content exceeds 1.5%, embrittlement is promoted. Re is a rare element, and when its contained amount is increased, a production cost increases. Therefore, the Re content is determined to be 0.01 to 1.5%. For the same reason, it is preferable that the Re content is 0.1 to 0.6%.

The heat resistant cast steel of the above-described component element range is suitable as a material configuring, for example, cast parts of the steam turbine. Examples of the cast parts of the steam turbine include turbine casings (such as a high pressure turbine casing, an intermediate pressure turbine casing, and a high and intermediate pressure turbine casing), valve casings (casings for a main steam stop valve, a control valve, a reheat stop valve, etc.), nozzle boxes, and the like.

Here, the turbine casing is a casing that configures a turbine casing where a turbine rotor having turbine rotor blades implanted is disposed through it, a nozzle is located in the inner circumferential surface thereof, and steam is introduced into it. The valve casing is a casing of a valve which functions as a steam valve to adjust a flow rate of a high-temperature high-pressure steam supplied to the steam turbine and to cut off the flow of steam. Especially, there is, for example, a casing of a valve where a high-temperature steam (for example, a steam temperature of 600 to 650° C.) flows. The nozzle box is an annular steam passage that is disposed to surround the turbine rotor to discharge the high-temperature high-pressure steam, which is introduced into the steam turbine, toward a first stage composed of a first stage nozzle and a first stage turbine rotor blade. All of the turbine casing, the valve casing and the nozzle box are disposed in an environment where they are exposed to the high-temperature high-pressure steam.

All portions of the cast parts of the steam turbine described above may be made of the above-described heat resistant cast steel, and some portions of the cast parts of the steam turbine may be made of the above-described heat resistant cast steel.

The heat resistant cast steel of the component element range described above is excellent in a long creep rupture life and also in creep rupture ductility and toughness. In addition, this heat resistant cast steel is suppressed from having aging deterioration after a high-temperature long-term operation. And, this heat resistant cast steel is also excellent in weldability. Therefore, this heat resistant cast steel can be used to form cast parts of the steam turbine, such as a turbine casing, a valve casing and a nozzle box so as to provide the cast parts such as a turbine casing, a valve casing and a nozzle box having high reliability even in a high temperature environment.

Here, a manufacturing method of the heat resistant cast steel of the embodiment, and a manufacturing method of cast parts of the steam turbine, which are manufactured by using this heat resistant cast steel, are described below.

For example, the heat resistant cast steel of the embodiment is manufactured as follows.

Raw materials required to obtain component elements, which configure the above-described heat resistant cast steel, are melted in a melting furnace such as an arc type electric furnace or a vacuum induction furnace to perform refining and degassing. Subsequently, the molten metal is poured into, for example, a sand mold for positively carrying out directional solidification, and solidified over time. The cast steel material which is solidified and cooled to a transformation temperature or below is removed from the mold, undergone high temperature annealing at a temperature of 1000 to 1150° C. to recrystallize and disperse the primary crystal structure and microsegregation which were formed at the time of casting. Then, a quality heat treatment process (normalizing treatment and tempering treatment) is carried out. The heat resistant cast steel is manufactured through the above steps.

For example, the cast parts of the steam turbine, such as a turbine casing, a valve casing and a nozzle box, are manufactured as follows.

Here, the turbine casing, the valve casing and the nozzle box have a large casting weight value of about 2 to 150 tons (product weight of 1 to 50 tons). Therefore, advanced steel-manufacturing technology and casting technology are required to manufacture a cast steel having good internal quality.

Raw materials required to obtain component elements configuring the above-described heat resistant cast steel, which form the cast parts of the steam turbine, are melted in a melting furnace such as an arc type electric furnace or a vacuum induction furnace to perform refining and degassing. Subsequently, the molten metal is poured into a sand mold which is formed to conform to the shape of a cast part of the steam turbine and solidified over time. It is important to previously make casting designs such as a riser having a sufficient size, padding with enough directionality of solidification, and the like so as not to leave any cast defect, such as shrinkage cavities or cracks due to the solidification, within the product.

The cast steel material solidified and cooled to a transformation temperature or below is removed from the mold and undergone high temperature annealing at a temperature of 1000 to 1150° C. to break once the cast structure which was formed at the time of casting. In this state, the riser, which was required when casting and became a final solidified portion, is cut off, and the padding, which was attached to the product in order to make directional solidification, is removed.

In the annealing treatment, the cast steel material is preferably cooled relatively slowly at a cooling rate of 20 to 60° C./hour so that the cast steel material does not suffer from the occurrence of any crack in a stress concentration part such as a shape change portion when cooling after the annealing. As a cooling method to obtain the cooling rate of the above range, for example, furnace cooling or the like can be adopted. Since the cooling by the annealing treatment is carried out at a low cooling rate by furnace cooling or the like, a temperature difference between the center part and the outer periphery of the cast steel material is small in the cooling process. Therefore, for definition of the cooling rate in the annealing treatment, it is not limited to the center part of the cast steel material, but it may be, for example, a cooling rate at any position in the cast steel material, such as the center or the outer periphery of the cast steel material.

After the annealing treatment, a quality heat treatment process (normalizing treatment and tempering treatment) is carried out. Through the above steps, the cast parts of the steam turbine are manufactured.

Here, it is preferable that the annealing temperature is determined to be in a range of 1000 to 1150° C. because when the annealing temperature is less than 1000° C., the cast structure formed by casting is not broken down sufficiently. On the other hand, when the annealing temperature exceeds 1150° C., crystal grains become coarse and nonuniform, and there is a tendency that a crack occurs at the time of cutting off the riser or removing the padding.

The method of manufacturing the heat resistant cast steel or the cast parts of the steam turbine is not limited to the above-described method.

The quality heat treatment process is described below.

(Normalizing Treatment)

Most of carbide and carbonitride generated in the material is once put in a state of solid-solution in a matrix by heating for normalizing, and the carbide and carbonitride are then precipitated uniformly in a fine state in the matrix by the subsequent tempering treatment. Thus, high temperature creep rupture strength, creep rupture ductility and toughness can be improved.

It is preferable that the normalizing temperature is determined to be in a range of 1000 to 1200° C. When the normalizing temperature is less than 1000° C., a solid-solution of relatively coarse carbide and carbonitride, which have precipitated before the casting process, in the matrix is not formed sufficiently, and even after the subsequent tempering treatment, they remain as coarse non-solid solution carbide and non-solid solution carbonitride. Therefore, it is difficult to obtain good high temperature creep rupture strength, ductility and toughness. Meanwhile, when the normalizing temperature exceeds 1200° C., the crystal grains are coarsened, and ductility and toughness are reduced.

In the normalizing treatment, it is preferable that the cast steel material is cooled at a cooling rate of 100 to 600° C./hour in the center part of the cast steel material in order to obtain a predetermined fine structure after the normalizing treatment. As a cooling method to obtain the cooling rate of the above range, for example, forced-air cooling or the like can be used.

In a case where the cast steel material is a casing or a nozzle box, the center part of the cast steel material is, for example, a center part of the wall thickness of the casing or the nozzle box. That is, such a portion is a part of the cast steel material where the cooling rate becomes smallest. Here, the cooling rate in the center part of the cast steel material is defined, but the above cooling rate may be a cooling rate at a portion of the cast steel material where the cooling rate is smallest. And, the same is also applied to the tempering treatment.

(Tempering Treatment)

The retained austenitic structure generated by the above-described normalizing treatment is decomposed by the tempering treatment to have a tempered martensitic structure, carbide and carbonitride are uniformly dispersed and precipitated in a matrix, and a dislocation structure is recovered to an appropriate level. Thus, the required high temperature creep rupture strength, rupture ductility and toughness can be obtained.

This tempering treatment is preferably carried out two times. A first tempering treatment (first stage tempering treatment) aims to decompose the retained austenitic structure, and it is preferably carried out at a temperature in a range of 500 to 700° C. When the temperature of the first stage tempering treatment is less than 500° C., the retained austenitic structure is not decomposed sufficiently. On the other hand, when the temperature of the first stage tempering treatment exceeds 700° C., carbide and carbonitride tend to precipitate preferentially in the martensitic structure than in the retained austenitic structure, the precipitate is distributed non-uniformly, and high temperature creep rupture strength is reduced.

In the first stage tempering treatment, the cast steel material is preferably cooled at a cooling rate of 40 to 100° C./hour in the center part of the cast steel material so that a large distortion is not generated at a stress concentration part such as a shape change portion when cooling after the first stage tempering treatment. As a cooling method to obtain the cooling rate of the above range, for example, air cooling or the like can be adopted.

A second tempering treatment (second stage tempering treatment) aims to obtain the required high temperature creep rupture strength, rupture ductility and toughness by making the entire material have a tempered martensitic structure, and it is preferably carried out at a temperature in a range of 700° C. to 780° C. When the temperature of the second stage tempering treatment is less than 700° C., precipitates such as carbide and carbonitride are not precipitated in a stable state, so that the necessary characteristics cannot be obtained for high temperature creep rupture strength, ductility and toughness. On the other hand, when the temperature of the second stage tempering treatment exceeds 780° C., coarse precipitates of carbide and carbonitride are formed, and the required high temperature creep rupture strength cannot be obtained.

In the second stage tempering treatment, the cast steel material is preferably cooled at a cooling rate of 20 to 60° C./hour so that the distortion is not generated in a stress concentration part such as a shape change portion when cooling after the second stage tempering treatment. As a cooling method to obtain the cooling rate of the above range, for example, furnace cooling or the like can be adopted. Since cooling in the second stage tempering treatment is carried out by furnace cooling or the like at a low cooling rate, a temperature difference between the center part and the outer periphery of the cast steel material is small in the cooling process. Therefore, for definition of the cooling rate in the second stage tempering treatment, it is not limited to the center part of the cast steel material, but for example it may be a cooling rate at any position in the cast steel material, such as the center part or the outer periphery of the cast steel material.

Cast parts of the steam turbine, which are made of the heat resistant cast steel of the embodiment, can be welded by, for example, structural welding for bonding short pipes, and repair welding for repairing cast defects. For example, welding is carried out after the above-described series of heat treatment, and then stress relief annealing is carried out at 650 to 760° C.

The welding can be carried out during the above-described series of heat treatment, namely after the high temperature annealing and before normalizing. After the welding, the above-described normalizing treatment and tempering treatment are carried out. In this case, the stress relief annealing is unnecessary. In a case where the welding is carried out during the heat treatment (after the high temperature annealing and before the normalizing) as described above, a structural welding portion and a repair welding portion are also subjected to the normalizing treatment and the tempering treatment. Therefore, the welded portions can also be provided with high temperature creep rupture strength, and good ductility and toughness.

It is described below that the heat resistant cast steel of the embodiment is excellent in high temperature creep rupture characteristics (high temperature creep rupture life and rupture elongation), toughness (Charpy impact value at room temperature, and fracture appearance transition temperature (FATT)), weldability and aging deterioration property after high isothermal aging.

(Test Sample)

Table 1 and Table 2 show chemical component elements (a remainder comprising Fe and unavoidable impurities) of various test samples (test sample 1 to test sample 75) used for evaluation of material characteristics. Test sample 1 to test sample 66 shown in Table 1 are examples of the heat resistant cast steel of the embodiment. Test sample 67 to test sample 75 shown in Table 2 are comparative examples of the heat resistant cast steel having a chemical composition range which is not in the chemical composition range of the heat resistant cast steel of the embodiment.

TABLE 1

| | | | | | | | | | | | | | | | | | % by mass |
|---|---|---|---|---|---|---|---|---|---|---|---|---|---|---|---|---|---|
| | | C | Si | Mn | Ni | Cr | Mo | V | Co | W | N | Nb | B | Ti | Ta | Zr | Re |
| EXAMPLE | TS1 | 0.12 | 0.1 | 0.5 | 0.3 | 8.6 | 0.31 | 0.22 | 2.8 | 1.7 | 0.018 | 0.06 | 0.003 | 0.02 | | | |
| | TS2 | 0.11 | 0.12 | 0.4 | 0.5 | 8.5 | 0.3 | 0.24 | 3.1 | 1.7 | 0.019 | 0.05 | 0.008 | 0.02 | | | |
| | TS3 | 0.1 | 0.08 | 0.4 | 0.5 | 8.7 | 0.33 | 0.23 | 3 | 1.8 | 0.02 | 0.05 | 0.014 | 0.03 | | | |
| | TS4 | 0.11 | 0.07 | 0.5 | 0.3 | 8.7 | 0.36 | 0.22 | 3 | 1.9 | 0.014 | 0.06 | 0.004 | 0.02 | | | |
| | TS5 | 0.09 | 0.11 | 0.6 | 0.4 | 8.7 | 0.35 | 0.2 | 2.7 | 1.7 | 0.015 | 0.04 | 0.007 | 0.02 | | | |
| | TS6 | 0.12 | 0.12 | 0.5 | 0.3 | 8.6 | 0.38 | 0.22 | 2.8 | 1.8 | 0.019 | 0.06 | 0.013 | 0.03 | | | |
| | TS7 | 0.1 | 0.1 | 0.5 | 0.5 | 8.7 | 0.62 | 0.21 | 3.1 | 1.7 | 0.018 | 0.05 | 0.004 | 0.03 | | | |
| | TS8 | 0.11 | 0.11 | 0.6 | 0.4 | 8.4 | 0.61 | 0.24 | 2.9 | 1.7 | 0.016 | 0.06 | 0.008 | 0.02 | | | |
| | TS9 | 0.11 | 0.12 | 0.5 | 0.4 | 8.5 | 0.64 | 0.21 | 2.8 | 1.8 | 0.018 | 0.05 | 0.014 | 0.02 | | | |
| | TS10 | 0.13 | 0.1 | 0.4 | 0.3 | 8.5 | 0.8 | 0.23 | 2.9 | 1.6 | 0.019 | 0.05 | 0.003 | 0.03 | | | |
| | TS11 | 0.1 | 0.11 | 0.5 | 0.5 | 8.6 | 0.82 | 0.22 | 2.9 | 1.8 | 0.017 | 0.04 | 0.007 | 0.02 | | | |
| | TS12 | 0.12 | 0.12 | 0.4 | 0.6 | 8.6 | 0.84 | 0.2 | 3 | 1.9 | 0.018 | 0.06 | 0.013 | 0.02 | | | |
| | TS13 | 0.12 | 0.09 | 0.6 | 0.4 | 9.1 | 0.33 | 0.23 | 3.1 | 1.8 | 0.015 | 0.07 | 0.003 | 0.02 | | | |
| | TS14 | 0.12 | 0.08 | 0.5 | 0.6 | 9.1 | 0.3 | 0.21 | 3 | 1.8 | 0.014 | 0.05 | 0.008 | 0.02 | | | |
| | TS15 | 0.1 | 0.1 | 0.5 | 0.4 | 9.3 | 0.31 | 0.19 | 3 | 1.8 | 0.017 | 0.04 | 0.013 | 0.03 | | | |
| | TS16 | 0.12 | 0.11 | 0.5 | 0.3 | 9.2 | 0.35 | 0.18 | 2.8 | 1.7 | 0.014 | 0.06 | 0.003 | 0.02 | | | |
| | TS17 | 0.13 | 0.12 | 0.6 | 0.4 | 9.2 | 0.36 | 0.23 | 2.7 | 1.9 | 0.018 | 0.05 | 0.007 | 0.02 | | | |
| | TS18 | 0.09 | 0.13 | 0.6 | 0.3 | 9 | 0.35 | 0.21 | 3.2 | 1.8 | 0.017 | 0.06 | 0.014 | 0.02 | | | |
| | TS19 | 0.1 | 0.11 | 0.4 | 0.5 | 9.2 | 0.38 | 0.2 | 2.9 | 1.7 | 0.015 | 0.05 | 0.008 | 0.03 | 0.05 | | |
| | TS20 | 0.12 | 0.12 | 0.3 | 0.6 | 9.1 | 0.37 | 0.21 | 2.8 | 1.6 | 0.018 | 0.05 | 0.009 | 0.03 | | | |
| | TS21 | 0.11 | 0.1 | 0.4 | 0.7 | 9 | 0.37 | 0.19 | 2.9 | 1.8 | 0.019 | 0.06 | 0.008 | 0.02 | | 0.04 | |
| | TS22 | 0.12 | 0.08 | 0.7 | 0.4 | 9 | 0.35 | 0.19 | 2.7 | 1.7 | 0.014 | 0.05 | 0.008 | 0.02 | | | 0.2 |
| | TS23 | 0.13 | 0.09 | 0.5 | 0.5 | 9.3 | 0.34 | 0.21 | 3.1 | 1.7 | 0.015 | 0.07 | 0.007 | 0.02 | 0.06 | | |

TABLE 1-continued

| | C | Si | Mn | Ni | Cr | Mo | V | Co | W | N | Nb | B | Ti | Ta | Zr | Re |
|---|---|---|---|---|---|---|---|---|---|---|---|---|---|---|---|---|
| | | | | | | | | | | | | | | | % by mass | |
| TS24 | 0.1 | 0.1 | 0.4 | 0.4 | 9.2 | 0.37 | 0.22 | 3 | 1.6 | 0.019 | 0.04 | 0.007 | 0.03 | 0.06 | 0.03 | |
| TS25 | 0.12 | 0.12 | 0.5 | 0.5 | 9.1 | 0.38 | 0.18 | 2.9 | 1.8 | 0.016 | 0.05 | 0.007 | 0.02 | 0.05 | | 0.3 |
| TS26 | 0.11 | 0.11 | 0.7 | 0.4 | 9.3 | 0.4 | 0.21 | 2.8 | 1.7 | 0.015 | 0.06 | 0.009 | 0.02 | | 0.04 | |
| TS27 | 0.1 | 0.13 | 0.5 | 0.5 | 9.2 | 0.37 | 0.21 | 2.9 | 1.6 | 0.014 | 0.04 | 0.007 | 0.03 | | | 0.2 |
| TS28 | 0.13 | 0.12 | 0.5 | 0.6 | 9 | 0.41 | 0.23 | 2.7 | 1.7 | 0.017 | 0.06 | 0.008 | 0.02 | | 0.04 | 0.2 |
| TS29 | 0.12 | 0.1 | 0.4 | 0.5 | 9.1 | 0.39 | 0.2 | 3 | 1.6 | 0.019 | 0.05 | 0.007 | 0.03 | 0.06 | 0.03 | |
| TS30 | 0.11 | 0.09 | 0.6 | 0.4 | 9 | 0.38 | 0.21 | 2.9 | 1.8 | 0.014 | 0.06 | 0.007 | 0.04 | 0.05 | | 0.3 |
| TS31 | 0.13 | 0.07 | 0.3 | 0.3 | 9.3 | 0.36 | 0.21 | 2.8 | 1.7 | 0.015 | 0.05 | 0.008 | 0.03 | | 0.05 | 0.2 |
| TS32 | 0.1 | 0.11 | 0.5 | 0.5 | 9.2 | 0.35 | 0.2 | 2.8 | 1.7 | 0.015 | 0.07 | 0.008 | 0.02 | 0.05 | 0.03 | 0.3 |
| TS33 | 0.11 | 0.12 | 0.8 | 0.5 | 9.2 | 0.37 | 0.19 | 2.7 | 1.7 | 0.018 | 0.05 | 0.007 | 0.03 | 0.06 | 0.04 | 0.2 |
| TS34 | 0.12 | 0.11 | 0.6 | 0.3 | 9 | 0.62 | 0.2 | 3 | 1.8 | 0.016 | 0.05 | 0.004 | 0.03 | | | |
| TS35 | 0.14 | 0.1 | 0.5 | 0.4 | 9.1 | 0.6 | 0.23 | 2.8 | 1.7 | 0.014 | 0.05 | 0.007 | 0.02 | | | |
| TS36 | 0.11 | 0.13 | 0.6 | 0.5 | 9.4 | 0.6 | 0.21 | 2.9 | 1.8 | 0.015 | 0.07 | 0.014 | 0.02 | | | |
| TS37 | 0.13 | 0.12 | 0.6 | 0.4 | 9.1 | 0.59 | 0.21 | 3 | 1.7 | 0.019 | 0.04 | 0.007 | 0.03 | 0.05 | | |
| TS38 | 0.1 | 0.11 | 0.7 | 0.4 | 9.2 | 0.57 | 0.23 | 2.7 | 1.8 | 0.015 | 0.05 | 0.007 | 0.03 | | | |
| TS39 | 0.11 | 0.1 | 0.4 | 0.5 | 9 | 0.61 | 0.21 | 3.1 | 1.8 | 0.014 | 0.04 | 0.009 | 0.02 | | 0.03 | |
| TS40 | 0.13 | 0.09 | 0.5 | 0.6 | 9 | 0.6 | 0.21 | 2.8 | 1.7 | 0.017 | 0.06 | 0.008 | 0.03 | | | 0.2 |
| TS41 | 0.1 | 0.11 | 0.7 | 0.6 | 9.2 | 0.65 | 0.23 | 2.9 | 1.7 | 0.014 | 0.05 | 0.007 | 0.03 | 0.06 | | |
| TS42 | 0.09 | 0.13 | 0.4 | 0.5 | 9,1 | 0.64 | 0.2 | 3 | 1.8 | 0.015 | 0.06 | 0.007 | 0.02 | 0.06 | 0.04 | |
| TS43 | 0.11 | 0.07 | 0.3 | 0.4 | 9.2 | 0.63 | 0.2 | 2.9 | 1.9 | 0.019 | 0.05 | 0.008 | 0.02 | 0.05 | | 0.2 |
| TS44 | 0.13 | 0.13 | 0.5 | 0.7 | 9.1 | 0.64 | 0.2 | 2.7 | 1.7 | 0.015 | 0.05 | 0.007 | 0.03 | | 0.04 | |
| TS45 | 0.12 | 0.12 | 0.5 | 0.4 | 9.2 | 0.59 | 0.22 | 3.2 | 1.6 | 0.014 | 0.04 | 0.006 | 0.04 | | | 0.2 |
| TS46 | 0.11 | 0.13 | 0.5 | 0.3 | 9 | 0.57 | 0.19 | 2.8 | 1.7 | 0.015 | 0.05 | 0.008 | 0.03 | | 0.05 | 0.3 |
| TS47 | 0.12 | 0.12 | 0.4 | 0.6 | 9 | 0.6 | 0.18 | 2.9 | 1.8 | 0.015 | 0.06 | 0.007 | 0.05 | 0.04 | 0.03 | |
| TS48 | 0.13 | 0.1 | 0.6 | 0.5 | 9.2 | 0.57 | 0.2 | 2.7 | 1.7 | 0.014 | 0.07 | 0.006 | 0.03 | 0.05 | | 0.3 |
| TS49 | 0.12 | 0.12 | 0.7 | 0.4 | 9.2 | 0.61 | 0.22 | 3.2 | 1.6 | 0.017 | 0.05 | 0.007 | 0.03 | | 0.05 | 0.2 |
| TS50 | 0.11 | 0.11 | 0.6 | 0.4 | 9 | 0.62 | 0.21 | 2.8 | 1.7 | 0.018 | 0.06 | 0.007 | 0.02 | 0.06 | 0.03 | 0.3 |
| TS51 | 0.13 | 0.12 | 0.5 | 0.5 | 9.1 | 0.61 | 0.2 | 2.9 | 1.7 | 0.017 | 0.05 | 0.008 | 0.05 | 0.05 | 0.03 | 0.2 |
| TS52 | 0.12 | 0.09 | 0.6 | 0.4 | 9.4 | 0.82 | 0.21 | 3 | 1.8 | 0.014 | 0.06 | 0.003 | 0.02 | | | |
| TS53 | 0.1 | 0.07 | 0.6 | 0.4 | 9.1 | 0.8 | 0.21 | 3 | 1.7 | 0.014 | 0.06 | 0.008 | 0.02 | | | |
| TS54 | 0.1 | 0.12 | 0.4 | 0.5 | 9 | 0.79 | 0.2 | 2.9 | 1.7 | 0.018 | 0.05 | 0.013 | 0.03 | | | |
| TS55 | 0.13 | 0.11 | 0.6 | 0.3 | 10 | 0.32 | 0.19 | 2.8 | 1.8 | 0.017 | 0.06 | 0.004 | 0.03 | | | |
| TS56 | 0.12 | 0.12 | 0.5 | 0.5 | 10.2 | 0.3 | 0.22 | 2.9 | 1.7 | 0.016 | 0.06 | 0.007 | 0.02 | | | |
| TS57 | 0.12 | 0.11 | 0.4 | 0.3 | 10.3 | 0.31 | 0.21 | 3 | 1.8 | 0.015 | 0.07 | 0.013 | 0.02 | | | |
| TS58 | 0.11 | 0.12 | 0.5 | 0.4 | 10.1 | 0.36 | 0.2 | 2.9 | 1.7 | 0.014 | 0.05 | 0.004 | 0.03 | | | |
| TS59 | 0.1 | 0.13 | 0.5 | 0.4 | 9.8 | 0.35 | 0.21 | 2.9 | 1.6 | 0.018 | 0.07 | 0.007 | 0.02 | | | |
| TS60 | 0.12 | 0.09 | 0.7 | 0.5 | 10 | 0.39 | 0.21 | 2.7 | 1.8 | 0.015 | 0.06 | 0.015 | 0.02 | | | |
| TS61 | 0.11 | 0.1 | 0.4 | 0.5 | 10.3 | 0.62 | 0.18 | 3.1 | 1.9 | 0.015 | 0.05 | 0.003 | 0.02 | | | |
| TS62 | 0.13 | 0.11 | 0.5 | 0.3 | 10.1 | 0.61 | 0.19 | 2.8 | 1.7 | 0.014 | 0.06 | 0.008 | 0.03 | | | |
| TS63 | 0.14 | 0.12 | 0.6 | 0.3 | 9.8 | 0.63 | 0.22 | 3 | 1.7 | 0.015 | 0.07 | 0.013 | 0.03 | | | |
| TS64 | 0.12 | 0.1 | 0.5 | 0.5 | 9.9 | 0.82 | 0.21 | 3.1 | 1.7 | 0.017 | 0.04 | 0.003 | 0.02 | | | |
| TS65 | 0.12 | 0.14 | 0.7 | 0.3 | 10.2 | 0.8 | 0.2 | 2.9 | 1.7 | 0.015 | 0.05 | 0.007 | 0.03 | | | |
| TS66 | 0.11 | 0.11 | 0.4 | 0.4 | 10.1 | 0.78 | 0.23 | 2.7 | 1.8 | 0.014 | 0.05 | 0.013 | 0.02 | | | |

TS = Test Sample

TABLE 2

| | | C | Si | Mn | Ni | Cr | Mo | V | Co | W | N | Nb | B | Ti | Ta | Zr | Re |
|---|---|---|---|---|---|---|---|---|---|---|---|---|---|---|---|---|---|
| | | | | | | | | | | | | | | | | % by mass | |
| Comparative Example | TS67 | 0.13 | 0.12 | 0.5 | 0.5 | 7.5 | 0.55 | 0.2 | 3 | 1.8 | 0.019 | 0.06 | 0.007 | 0.02 | | | |
| | TS68 | 0.11 | 0.13 | 0.7 | 0.3 | 11.1 | 0.61 | 0.2 | 2.8 | 1.8 | 0.02 | 0.04 | 0.008 | 0.03 | | | |
| | TS69 | 0.12 | 0.1 | 0.5 | 0.3 | 11.8 | 0.63 | 0.22 | 3 | 1.6 | 0.016 | 0.07 | 0.008 | 0.02 | | | |
| | TS70 | 0.11 | 0.1 | 0.4 | 0.5 | 9.1 | 0.15 | 0.21 | 2.9 | 1.7 | 0.017 | 0.07 | 0.007 | 0.03 | | | |
| | TS71 | 0.13 | 0.11 | 0.5 | 0.4 | 9.2 | 1.6 | 0.19 | 2.9 | 1.6 | 0.015 | 0.05 | 0.007 | 0.03 | | | |
| | TS72 | 0.1 | 0.12 | 0.6 | 0.4 | 9 | 1.9 | 0.19 | 2.7 | 1.7 | 0.017 | 0.05 | 0.008 | 0.03 | | | |
| | TS73 | 0.12 | 0.1 | 0.7 | 0.3 | 9.1 | 0.52 | 0.22 | 3.1 | 1.8 | 0.017 | 0.06 | 0.001 | 0.02 | | | |
| | TS74 | 0.12 | 0.09 | 0.5 | 0.3 | 9.2 | 0.58 | 0.2 | 3 | 1.6 | 0.016 | 0.06 | 0.02 | 0.02 | | | |
| | TS75 | 0.13 | 0.08 | 0.6 | 0.4 | 8.9 | 0.6 | 0.21 | 2.8 | 1.6 | 0.018 | 0.04 | 0.025 | 0.02 | | | |

TS = Test Sample

These test samples were formed as follows. Raw materials configuring each test sample were melted in a vacuum induction furnace (VIM) to perform degassing, and the molten metal was poured into a sand mold. Thus, there was produced 50 kg of a steel ingot.

Subsequently, each steel ingot was subjected to the heat treatment including high temperature annealing, normalizing, first stage tempering and second stage tempering.

In the high temperature annealing treatment, the steel ingot was held heated at a temperature of 1070° C. for 20 hours, and then cooled at a cooling rate of 50° C./hour. Here, the cooling rate in the high temperature annealing treatment was determined to be a cooling rate in the center part of the steel ingot. In the normalizing treatment, the steel ingot after the high temperature annealing treatment was held heated at a temperature of 1100° C. for 10 hours and then cooled at a cooling rate of 300° C./hour (cooling rate in the center part of the steel ingot). In the first stage tempering treatment, the steel ingot after the normalizing treatment was held heated at a temperature of 570° C. for 8 hours and then cooled at a cooling rate of 100° C./hour (cooling rate in the center part of the steel ingot). In the second stage tempering treatment, the steel ingot after the first stage tempering treatment was held heated at a temperature of 730° C. for 16 hours and then cooled at a cooling rate of 50° C./hour. The cooling rate in the second stage tempering treatment was determined to be a cooling rate in the center part of the steel ingot.

(Creep Rupture Test)

The above-described test sample 1 to test sample 75 were used to carry out the creep rupture test under conditions of 625° C. and 18 kgf/mm$^2$ and those of 625° C. and 13 kgf/mm$^2$. Test pieces were produced from the above individual steel ingots.

The creep rupture test was carried out according to JIS Z 2271 (Method of Creep and Creep Rupture Testing for Metallic Materials). Table 3 and Table 4 show the results of the creep rupture test on the individual test samples. Table 3 and Table 4 show the creep rupture life (hour) and creep rupture elongation (%) as the creep rupture test results.

TABLE 3

| | | Creep rupture characteristics | | | | Toughness | | |
|---|---|---|---|---|---|---|---|---|
| | | 625° C., 18 kgf/mm$^2$ | | 625° C., 13 kgf/mm$^2$ | | Charpy | Fracture | |
| | | Creep rupture life, hour | Creep rupture elongation, % | Creep rupture life, hour | Creep rupture elongation, % | impact value at room temperature, kgf-m/cm$^2$ | appearance transition temperature (FATT), ° C. | Weldability |
| Example | TS1 | 2110 | 21.7 | 17634 | 21.5 | 5.8 | 57 | ○ |
| | TS2 | 2483 | 22.4 | 21378 | 22 | 4.9 | 63 | ○ |
| | TS3 | 2165 | 20.7 | 17987 | 20.7 | 4.1 | 81 | ○ |
| | TS4 | 2206 | 21.9 | 20956 | 20.3 | 5.6 | 55 | ○ |
| | TS5 | 2685 | 22 | 21098 | 21.7 | 4.8 | 60 | ○ |
| | TS6 | 2345 | 22 | 19893 | 21.9 | 4.5 | 78 | ○ |
| | TS7 | 2139 | 21.7 | 21217 | 21 | 6.2 | 53 | ○ |
| | TS8 | 2658 | 21.4 | 22459 | 20.8 | 5.1 | 56 | ○ |
| | TS9 | 2231 | 21.7 | 21349 | 21.3 | 4.4 | 80 | ○ |
| | TS10 | 1989 | 21 | 17854 | 21.1 | 5.8 | 53 | ○ |
| | TS11 | 2542 | 22.4 | 20129 | 21.5 | 5 | 58 | ○ |
| | TS12 | 1897 | 20.7 | 16873 | 20.7 | 4.2 | 76 | ○ |
| | TS13 | 2348 | 23 | 16034 | 21.4 | 5.6 | 53 | ○ |
| | TS14 | 2657 | 21.7 | 21934 | 20.8 | 4.9 | 58 | ○ |
| | TS15 | 2542 | 21.7 | 17683 | 20.7 | 4.2 | 75 | ○ |
| | TS16 | 2652 | 21.4 | 20945 | 20.5 | 5.7 | 53 | ○ |
| | TS17 | 3013 | 21.4 | 25345 | 19.7 | 4.6 | 57 | ○ |
| | TS18 | 2765 | 22.3 | 22397 | 20.7 | 4.3 | 75 | ○ |
| | TS19 | 3128 | 22 | 27409 | 20.7 | 5.3 | 57 | ○ |
| | TS20 | 3207 | 21.7 | 27128 | 21.3 | 5.8 | 54 | ○ |
| | TS21 | 2896 | 22.4 | 24734 | 21.5 | 5.6 | 52 | ○ |
| | TS22 | 3129 | 21.4 | 27637 | 21.1 | 4.9 | 68 | ○ |
| | TS23 | 3249 | 22.3 | 30451 | 20.8 | 4.7 | 56 | ○ |
| | TS24 | 3223 | 22 | 26893 | 20.6 | 5.7 | 59 | ○ |
| | TS25 | 3327 | 22 | 31258 | 21.2 | 5.3 | 53 | ○ |
| | TS26 | 3129 | 20.7 | 27345 | 21.1 | 5.5 | 54 | ○ |
| | TS27 | 3249 | 22.3 | 29876 | 20.9 | 4.8 | 67 | ○ |
| | TS28 | 3183 | 21.4 | 27276 | 20.7 | 5.7 | 50 | ○ |
| | TS29 | 3276 | 21.4 | 30231 | 21.2 | 5.8 | 54 | ○ |
| | TS30 | 3547 | 22 | 32378 | 20.7 | 5.2 | 51 | ○ |
| | TS31 | 3342 | 22 | 30561 | 20.5 | 6.1 | 53 | ○ |
| | TS32 | 3284 | 21.4 | 28947 | 23 | 6 | 57 | ○ |
| | TS33 | 3578 | 22 | 32374 | 22.7 | 5.7 | 50 | ○ |
| | TS34 | 2685 | 22.7 | 21873 | 21.7 | 5.9 | 55 | ○ |
| | TS35 | 3034 | 22.4 | 25428 | 20.3 | 5.3 | 65 | ○ |
| | TS36 | 2804 | 21.4 | 20071 | 21.3 | 4.6 | 73 | ○ |
| | TS37 | 3127 | 22.3 | 27659 | 20.7 | 5.2 | 56 | ○ |
| | TS38 | 3127 | 21.4 | 26941 | 20.4 | 5.2 | 51 | ○ |
| | TS39 | 2994 | 23.3 | 22783 | 21.1 | 6.1 | 50 | ○ |
| | TS40 | 3203 | 22.7 | 27665 | 22.3 | 5 | 56 | ○ |
| | TS41 | 3378 | 20 | 30034 | 21.7 | 5.3 | 63 | ○ |
| | TS42 | 3128 | 21.8 | 27665 | 22 | 6.1 | 57 | ○ |
| | TS43 | 3352 | 20.7 | 31086 | 21.7 | 5.1 | 59 | ○ |
| | TS44 | 3129 | 21.4 | 26871 | 20.5 | 6.2 | 53 | ○ |
| | TS45 | 3235 | 21 | 31328 | 21.5 | 5.4 | 54 | ○ |
| | TS46 | 3128 | 21.3 | 27650 | 21.2 | 6 | 59 | ○ |
| | TS47 | 3342 | 22 | 31967 | 22 | 5.8 | 56 | ○ |
| | TS48 | 3541 | 21.7 | 32395 | 20.8 | 5.2 | 55 | ○ |
| | TS49 | 3348 | 21.4 | 30341 | 21.3 | 6.1 | 58 | ○ |
| | TS50 | 3352 | 22.7 | 28956 | 21.5 | 5.8 | 54 | ○ |
| | TS51 | 3701 | 22.7 | 32784 | 22.5 | 5.7 | 52 | ○ |
| | TS52 | 1913 | 21.7 | 17563 | 21.7 | 6.2 | 55 | ○ |
| | TS53 | 2237 | 22 | 20846 | 21.1 | 4.8 | 60 | ○ |
| | TS54 | 1872 | 23.7 | 18674 | 21.5 | 4.5 | 78 | ○ |
| | TS55 | 2139 | 22.1 | 15783 | 21.7 | 4.6 | 58 | ○ |
| | TS56 | 2612 | 22.1 | 18773 | 21.5 | 5.8 | 55 | ○ |
| | TS57 | 2274 | 23.4 | 16856 | 23.3 | 5.2 | 58 | ○ |
| | TS58 | 2341 | 21.4 | 14978 | 22.7 | 6 | 56 | ○ |
| | TS59 | 2789 | 21.7 | 21343 | 21.5 | 5.8 | 60 | ○ |

TABLE 3-continued

| | Creep rupture characteristics | | | | Toughness | | |
|---|---|---|---|---|---|---|---|
| | 625° C., 18 kgf/mm$^2$ | | 625° C., 13 kgf/mm$^2$ | | Charpy | Fracture | |
| | Creep rupture life, hour | Creep rupture elongation, % | Creep rupture life, hour | Creep rupture elongation, % | impact value at room temperature, kgf-m/cm$^2$ | appearance transition temperature (FATT), ° C. | Weldability |
| TS60 | 2436 | 22 | 16894 | 21.7 | 5 | 63 | ○ |
| TS61 | 2394 | 21.4 | 15128 | 20.7 | 5.3 | 65 | ○ |
| TS62 | 2768 | 20.7 | 22197 | 21.3 | 5.1 | 58 | ○ |
| TS63 | 2493 | 20 | 16843 | 21.2 | 4.8 | 65 | ○ |
| TS64 | 2236 | 21.8 | 13692 | 21.7 | 4.2 | 76 | ○ |
| TS65 | 2651 | 20.7 | 19568 | 21.5 | 4.5 | 78 | ○ |
| TS66 | 2389 | 20 | 14583 | 22.7 | 5 | 83 | ○ |

TS = Test Sample

TABLE 4

| | | Creep rupture characteristics | | | | Toughness | | |
|---|---|---|---|---|---|---|---|---|
| | | 625° C., 18 kgf/mm$^2$ | | 625° C., 13 kgf/mm$^2$ | | Charpy | Fracture | |
| | | Creep rupture life, hour | Creep rupture elongation, % | Creep rupture life, hour | Creep rupture elongation, % | impact value at room temperature, kgf-m/cm$^2$ | appearance transition temperature (FATT), ° C. | Weldability |
| Comparative Example | TS67 | 1895 | 21.7 | 9231 | 20.5 | 4.9 | 57 | ○ |
| | TS68 | 2736 | 20 | 7642 | 20.3 | 5.2 | 55 | ○ |
| | TS69 | 2504 | 20.7 | 5129 | 19.8 | 4.7 | 74 | ○ |
| | TS70 | 1524 | 20.3 | 8561 | 20 | 6.2 | 55 | ○ |
| | TS71 | 2826 | 15.1 | 16957 | 15.3 | 4.2 | 78 | ○ |
| | TS72 | 2432 | 13.2 | 15032 | 13.7 | 3.4 | 97 | X |
| | TS73 | 796 | 21.7 | 8872 | 19.7 | 5 | 55 | ○ |
| | TS74 | 2303 | 13.2 | 18495 | 13 | 3.4 | 95 | X |
| | TS75 | 1832 | 12.7 | 14856 | 12.5 | 2.5 | 103 | X |

TS = Test Sample

It is seen as shown in Table 3 and Table 4 that test sample 1 to test sample 66 have a long creep rupture life with the creep rupture strength improved under creep conditions of 625° C. and 18 kgf/mm$^2$ and those of 625° C. and 13 kgf/mm$^2$ in comparison with test sample 73 (with B content lower than the chemical composition range of the heat resistant cast steel of the embodiment).

It is seen that test sample 1 to test sample 66 have a long creep rupture life with creep rupture strength improved under creep conditions of 625° C. and 13 kgf/mm$^2$ in comparison with test sample 67 to test sample 69 (with Cr content outside the chemical composition range of the heat resistant cast steel of the embodiment).

It is also seen that test sample 1 to test sample 66 have the creep rupture elongation improved under creep conditions of 625° C. and 18 kgf/mm$^2$ and those of 625° C. and 13 kgf/mm$^2$ in comparison with test sample 71 and test sample 72 (with Mo content larger than the chemical composition range of the heat resistant cast steel of the embodiment) and test sample 74 and test sample 75 (with B content larger than the chemical composition range of the heat resistant cast steel of the embodiment).

(Charpy Impact Test)

The above-described test sample 1 to test sample 75 were undergone a Charpy impact test under several types of temperature conditions required to obtain room temperature and fracture appearance transition temperature (FATT). Test pieces were produced form the above-described individual steel ingots.

The Charpy impact test was carried out according to JIS Z 2242 (Charpy impact test method for metallic materials). Table 3 and Table 4 show the Charpy impact test results of the individual test samples. Table 3 and Table 4 show Charpy impact values (kgf-m/cm$^2$) at room temperature and fracture appearance transition temperatures (FATT)(° C.) as the Charpy impact test results.

It is seen as shown in Table 3 and Table 4 that test sample 1 to test sample 66 have a high Charpy impact value at room temperature with fracture appearance transition temperature (FATT) lowered and toughness improved in comparison with test sample 72 (with Mo content larger than the chemical composition range of the heat resistant cast steel of the embodiment).

It is seen that test sample 1 to test sample 66 have a high Charpy impact value at room temperature with fracture appearance transition temperature (FATT) lowered and toughness improved in comparison with test sample 74 and test sample 75 (with B content larger than the chemical composition range of the heat resistant cast steel of the embodiment).

(Weldability Test)

The above-described test sample 1 to test sample 75 were undergone a weldability test. As test pieces, flat plates (length of 280 mm, width of 100 mm, and thickness of 30 mm) were produced from the above-described individual steel ingots. FIG. 1 is a plan view of a flat plate 10.

As shown in FIG. 1, welding beads 20 were formed in the surface of the flat plate 10 by welding three paths with a predetermined welding rod. And, weldability was evaluated depending on the presence or not of a crack in five cross sections (those indicated by dotted lines in FIG. 1) perpendicular to the welding beads 20. The presence or not of a crack was judged by observing the individual cross sections visually or by a penetrant inspection method.

In a case where a crack was detected in at least one among the five cross sections, it was evaluated that weldability was inferior. Meanwhile, in a case where no crack was detected in all of the five cross sections, it was evaluated that weldability was excellent. Table 3 and Table 4 show the results of weldability test on the individual test samples. In Table 3 and Table 4, "o" is indicated when it is evaluated that weldability is excellent and "x" is indicated when it is evaluated that weldability is inferior.

It is seen as shown in Table 3 and Table 4 that test sample 1 to test sample 66 each are excellent in weldability. Meanwhile, test sample 72 (with Mo content larger than the chemical composition range of the heat resistant cast steel of the embodiment) and test sample 74 and test sample 75 (with B content larger than the chemical composition range of the heat resistant cast steel of the embodiment) are inferior in weldability.

(Evaluation of Aging Deterioration Characteristics)

Isothermal aging treatment was carried out at 625° C. for 10000 hours, creep rupture characteristics and toughness were evaluated, and aging deterioration of characteristics was evaluated.

First, the creep rupture characteristics are described below.

The test pieces produced from the individual steel ingots made of the above-described test sample 1 to test sample 75 were subjected to the isothermal aging treatment at 625° C. for 10000 hours, and a creep rupture test was carried out under conditions of 625° C. and 18 kgf/mm$^2$ and those of 625° C. and 13 kgf/mm$^2$. The creep rupture test was carried out according to JIS Z 2271 (Method of Creep and Creep Rupture Testing for Metallic Materials) in the same manner as that described above.

Table 5 and Table 6 show the results of the creep rupture test on the individual test samples after the isothermal aging treatment. Table 5 and Table 6 show a creep rupture life (hour), creep rupture elongation (%), creep rupture life ratio and creep rupture elongation ratio as the results of the creep rupture test. Here, the creep rupture life ratio was obtained by dividing the creep rupture life (hour) after the isothermal aging treatment by the creep rupture life (hour) after the quality heat treatment process, namely before the isothermal aging treatment. And, the creep rupture elongation ratio was obtained by dividing the creep rupture elongation (%) after the isothermal aging treatment by the creep rupture elongation (%) after the quality heat treatment process, namely before the isothermal aging treatment.

TABLE 5

| | | Creep rupture characteristics | | | | | | | |
|---|---|---|---|---|---|---|---|---|---|
| | | 625° C., 18 kgf/mm$^2$ | | | | 625° C., 13 kgf/mm$^2$ | | | |
| | | Creep rupture life, hour | Creep rupture life ratio | Creep rupture elongation, % | Creep rupture elongation ration | Creep rupture life, hour | Creep rupture life ratio | Creep rupture elongation, % | Creep rupture elongation ration |
| Example | TS1 | 1805 | 0.8555 | 20.4 | 0.9401 | 15673 | 0.8888 | 21.1 | 0.9814 |
| | TS2 | 2164 | 0.8715 | 20.5 | 0.9152 | 17646 | 0.8254 | 21.5 | 0.9773 |
| | TS3 | 1983 | 0.9159 | 21 | 1.0145 | 16058 | 0.8928 | 20.8 | 1.0048 |
| | TS4 | 2017 | 0.9143 | 20.6 | 0.9406 | 18064 | 0.8620 | 20.5 | 1.0099 |
| | TS5 | 2437 | 0.9076 | 21 | 0.9545 | 20341 | 0.9641 | 19.8 | 0.9124 |
| | TS6 | 2093 | 0.8925 | 21 | 0.9545 | 17845 | 0.8970 | 20.2 | 0.9224 |
| | TS7 | 1982 | 0.9266 | 20.5 | 0.9447 | 17856 | 0.8416 | 21.3 | 1.0143 |
| | TS8 | 2462 | 0.9263 | 21.2 | 0.9907 | 19863 | 0.8844 | 21 | 1.0096 |
| | TS9 | 2095 | 0.9390 | 21.5 | 0.9908 | 18005 | 0.8434 | 20.6 | 0.9671 |
| | TS10 | 1876 | 0.9432 | 21.8 | 1.0381 | 15460 | 0.8659 | 20.5 | 0.9716 |
| | TS11 | 2175 | 0.8556 | 21 | 0.9375 | 17845 | 0.8865 | 20.9 | 0.9721 |
| | TS12 | 1785 | 0.9410 | 22.2 | 1.0725 | 15005 | 0.8893 | 19.7 | 0.9517 |
| | TS13 | 2238 | 0.9532 | 21.6 | 0.9391 | 14358 | 0.8955 | 21.2 | 0.9907 |
| | TS14 | 2429 | 0.9142 | 22 | 1.0138 | 19045 | 0.8683 | 20.6 | 0.9904 |
| | TS15 | 2425 | 0.9540 | 20.8 | 0.9585 | 15466 | 0.8746 | 19.8 | 0.9565 |
| | TS16 | 2483 | 0.9363 | 20.6 | 0.9626 | 18965 | 0.9055 | 19.3 | 0.9415 |
| | TS17 | 2768 | 0.9187 | 20.2 | 0.9439 | 22317 | 0.8805 | 20 | 1.0152 |
| | TS18 | 2579 | 0.9327 | 21.3 | 0.9552 | 20784 | 0.9280 | 19.5 | 0.9420 |
| | TS19 | 2871 | 0.9178 | 21.4 | 0.9727 | 24538 | 0.8953 | 19.1 | 0.9227 |
| | TS20 | 3057 | 0.9532 | 21 | 0.9677 | 25045 | 0.9232 | 20.3 | 0.9531 |
| | TS21 | 2768 | 0.9558 | 22.3 | 0.9955 | 23418 | 0.9468 | 20.5 | 0.9535 |
| | TS22 | 2896 | 0.9255 | 21.7 | 1.0140 | 24538 | 0.8879 | 18.8 | 0.8910 |
| | TS23 | 3014 | 0.9277 | 21.1 | 0.9462 | 28673 | 0.9416 | 19 | 0.9135 |
| | TS24 | 2985 | 0.9262 | 21.4 | 0.9727 | 24297 | 0.9035 | 19.7 | 0.9563 |
| | TS25 | 3178 | 0.9552 | 22 | 1 | 27684 | 0.8857 | 18.9 | 0.8915 |
| | TS26 | 2894 | 0.9249 | 22.3 | 1.0773 | 25004 | 0.9144 | 20.5 | 0.9716 |
| | TS27 | 3208 | 0.9874 | 21.6 | 0.9686 | 28231 | 0.9449 | 19.8 | 0.9474 |
| | TS28 | 2953 | 0.9277 | 21.5 | 1.0047 | 25490 | 0.9345 | 20.3 | 0.9807 |
| | TS29 | 3164 | 0.9658 | 21.7 | 1.0140 | 28675 | 0.9485 | 20.1 | 0.9481 |
| | TS30 | 3356 | 0.9462 | 21.2 | 0.9636 | 30044 | 0.9279 | 19.2 | 0.9275 |
| | TS31 | 3034 | 0.9078 | 21.1 | 0.9591 | 28778 | 0.9417 | 19.4 | 0.9463 |
| | TS32 | 3249 | 0.9893 | 20.7 | 0.9673 | 27833 | 0.9615 | 18.3 | 0.7957 |
| | TS33 | 3324 | 0.9290 | 21.4 | 0.9727 | 30911 | 0.9548 | 19.8 | 0.8722 |
| | TS34 | 2473 | 0.9210 | 22 | 0.9692 | 18775 | 0.8584 | 20.3 | 0.9355 |
| | TS35 | 2805 | 0.9245 | 21.8 | 0.9732 | 22387 | 0.8804 | 20.7 | 1.0197 |

TABLE 5-continued

| | Creep rupture characteristics | | | | | | | |
|---|---|---|---|---|---|---|---|---|
| | 625° C., 18 kgf/mm$^2$ | | | | 625° C., 13 kgf/mm$^2$ | | | |
| | Creep rupture life, hour | Creep rupture life ratio | Creep rupture elongation, % | Creep rupture elongation ration | Creep rupture life, hour | Creep rupture life ratio | Creep rupture elongation, % | Creep rupture elongation ration |
| TS36 | 2655 | 0.9469 | 21.4 | 1 | 16983 | 0.8461 | 20.5 | 0.9624 |
| TS37 | 3004 | 0.9607 | 22.1 | 0.9910 | 25467 | 0.9207 | 18.6 | 0.8986 |
| TS38 | 2965 | 0.9482 | 20.8 | 0.9720 | 25445 | 0.9445 | 18.8 | 0.9216 |
| TS39 | 2763 | 0.9228 | 21.5 | 0.9227 | 19432 | 0.8529 | 21 | 0.9953 |
| TS40 | 3106 | 0.9697 | 21.6 | 0.9515 | 25449 | 0.9199 | 21.3 | 0.9552 |
| TS41 | 3167 | 0.9375 | 22.2 | 1.11 | 28034 | 0.9334 | 20.5 | 0.9447 |
| TS42 | 2996 | 0.9578 | 21.9 | 1.0046 | 24533 | 0.8868 | 19.6 | 0.8909 |
| TS43 | 3173 | 0.9466 | 21.8 | 1.0531 | 28776 | 0.9257 | 20.4 | 0.9401 |
| TS44 | 3110 | 0.9939 | 21.5 | 1.0047 | 25188 | 0.9374 | 20 | 0.9756 |
| TS45 | 3106 | 0.9601 | 22.8 | 1.0857 | 28783 | 0.9188 | 18.9 | 0.8791 |
| TS46 | 3053 | 0.9760 | 21.5 | 1.0094 | 25634 | 0.9271 | 20.1 | 0.9481 |
| TS47 | 3163 | 0.9464 | 21.4 | 0.9727 | 28767 | 0.8999 | 20.6 | 0.9364 |
| TS48 | 3358 | 0.9483 | 21 | 0.9677 | 30987 | 0.9565 | 21.1 | 1.0144 |
| TS49 | 3125 | 0.9334 | 21.5 | 1.0047 | 28787 | 0.9488 | 18.7 | 0.8779 |
| TS50 | 3134 | 0.9350 | 22.2 | 0.9780 | 27678 | 0.9559 | 20.5 | 0.9535 |
| TS51 | 3435 | 0.9281 | 21.8 | 0.9604 | 30248 | 0.9226 | 20.5 | 0.9111 |
| TS52 | 1756 | 0.9179 | 21.2 | 0.9770 | 16775 | 0.9551 | 21 | 0.9677 |
| TS53 | 2054 | 0.9182 | 21.5 | 0.9773 | 17506 | 0.8398 | 20.7 | 0.9810 |
| TS54 | 1659 | 0.8862 | 21.6 | 0.9114 | 17665 | 0.9460 | 19.4 | 0.9023 |
| TS55 | 2003 | 0.9364 | 21.8 | 0.9864 | 14343 | 0.9088 | 18.9 | 0.8710 |
| TS56 | 2348 | 0.8989 | 22 | 0.9955 | 17006 | 0.9059 | 21.2 | 0.9860 |
| TS57 | 2106 | 0.9261 | 21.7 | 0.9274 | 15054 | 0.8931 | 20.3 | 0.8712 |
| TS58 | 2207 | 0.9428 | 21.5 | 1.0047 | 13232 | 0.8834 | 20.6 | 0.9075 |
| TS59 | 2546 | 0.9129 | 21.7 | 1 | 20043 | 0.9391 | 21 | 0.9767 |
| TS60 | 2237 | 0.9183 | 22 | 1 | 15035 | 0.8900 | 19.7 | 0.9078 |
| TS61 | 2159 | 0.9018 | 20.3 | 0.9486 | 13443 | 0.8886 | 20.5 | 0.9903 |
| TS62 | 2564 | 0.9263 | 20.4 | 0.9855 | 20344 | 0.9165 | 18.8 | 0.8826 |
| TS63 | 2237 | 0.8973 | 20.5 | 1.0250 | 14089 | 0.8365 | 20.3 | 0.9575 |
| TS64 | 2105 | 0.9414 | 21.4 | 0.9817 | 12005 | 0.8768 | 19.9 | 0.9171 |
| TS65 | 2435 | 0.9185 | 21.6 | 1.0435 | 17867 | 0.9131 | 20 | 0.9302 |
| TS66 | 2234 | 0.9351 | 20.5 | 1.025 | 13035 | 0.8938 | 19.7 | 0.8678 |

TS = Test Sample

TABLE 6

| | | Creep rupture characteristics | | | | | | | |
|---|---|---|---|---|---|---|---|---|---|
| | | 625° C., 18 kgf/mm$^2$ | | | | 625° C., 13 kgf/mm$^2$ | | | |
| | | Creep rupture life, hour | Creep rupture life ratio | Creep rupture elongation, % | Creep rupture elongation ratio | Creep rupture life, hour | Creep rupture life ratio | Creep rupture elongation, % | Creep rupture elongation ratio |
| Comparative Example | TS67 | 1823 | 0.9620 | 22.5 | 1.0369 | 7028 | 0.7613 | 20.4 | 0.9951 |
| | TS68 | 2476 | 0.9050 | 19.2 | 0.96 | 5078 | 0.6645 | 19.3 | 0.9507 |
| | TS69 | 2137 | 0.8534 | 18.7 | 0.9034 | 3002 | 0.5853 | 17.7 | 0.8939 |
| | TS70 | 1402 | 0.9199 | 19.7 | 0.9704 | 7378 | 0.8618 | 19.5 | 0.975 |
| | TS71 | 2136 | 0.7558 | 11.3 | 0.7483 | 12345 | 0.7280 | 10.7 | 0.6993 |
| | TS72 | 1804 | 0.7418 | 10.5 | 0.7955 | 9778 | 0.6505 | 9.2 | 0.6715 |
| | TS73 | 734 | 0.9221 | 20 | 0.9217 | 8456 | 0.9531 | 18.7 | 0.9492 |
| | TS74 | 1685 | 0.7317 | 9.8 | 0.7424 | 12856 | 0.6951 | 9.3 | 0.7154 |
| | TS75 | 1135 | 0.6195 | 9.5 | 0.7480 | 9766 | 0.6574 | 8.8 | 0.704 |

TS = Test Sample

It is seen as shown in Table 5 and Table 6 that test sample 1 to test sample 66 have a large value of creep rupture life ratio and a small degradation of characteristics with age under creep conditions of 625° C. and 18 kgf/mm$^2$ and those of 625° C. and 13 kgf/mm$^2$ in comparison with test sample 71 and test sample 72 (with Mo content larger than the chemical composition range of the heat resistant cast steel of the embodiment).

And, it is seen that test sample 1 to test sample 66 have a large value of creep rupture life ratio and a small degradation of characteristics with age under creep conditions of 625° C. and 13 kgf/mm$^2$ in comparison with test sample 67 to test sample 69 (with Cr content outside the chemical composition range of the heat resistant cast steel of the embodiment).

It is seen that test sample 1 to test sample 66 have a large value of creep rupture elongation ratio and a small degradation of characteristics with age under creep conditions of 625° C. and 18 kgf/mm$^2$ and those of 625° C. and 13 kgf/mm$^2$ in comparison with test sample 71 and test sample 72 (with Mo content larger than the chemical composition range of the heat resistant cast steel of the embodiment) and test sample 74 and test sample 75 (with B content larger than the chemical composition range of the heat resistant cast steel of the embodiment).

Toughness is described below.

The test pieces produced from the individual steel ingots made of the above-described test sample 1 to test sample 75 were subjected to the isothermal aging treatment at 625° C. for 10000 hours, and a Charpy impact test was carried out under several types of temperature conditions required to obtain room temperature and a fracture appearance transition temperature (FATT). The Charpy impact test was carried out according to JIS Z 2242 (Charpy impact test method for metallic materials) in the same manner as that described above.

Table 7 and Table 8 show the results of the Charpy impact test performed on the individual test samples after the isothermal aging treatment. Table 5 and Table 6 show Charpy impact values (kgf-m/cm$^2$) at room temperature, fracture appearance transition temperatures (FATT) (° C.), Charpy impact value ratios and ΔFATT as the Charpy impact test results. Here, the Charpy impact value ratio was obtained by dividing the Charpy impact value (kgf-m/cm$^2$) after the isothermal aging treatment by the Charpy impact value (kgf-m/cm$^2$) after the quality heat treatment process, namely before the isothermal aging treatment. And, the ΔFATT was obtained by subtracting the fracture appearance transition temperature (FATT) (° C.) after the quality heat treatment process, namely before the isothermal aging treatment from the fracture appearance transition temperature (FATT) (° C.) after the isothermal aging treatment.

TABLE 7

| | | Toughness | | | |
|---|---|---|---|---|---|
| | | Charpy impace value at room temperature, kgf-m/cm$^2$ | Charpy impace value ratio | Fracture appearance transition temperature (FATT), ° C. | Δ FATT, ° C. |
| Example | TS1 | 5.2 | 0.8966 | 60 | 3 |
| | TS2 | 4.8 | 0.9796 | 58 | −5 |
| | TS3 | 3.9 | 0.9512 | 75 | −6 |
| | TS4 | 5.1 | 0.9107 | 63 | 8 |
| | TS5 | 4.5 | 0.9375 | 57 | −3 |
| | TS6 | 4.2 | 0.9333 | 73 | −5 |
| | TS7 | 5 | 0.8065 | 60 | 7 |
| | TS8 | 4.9 | 0.9608 | 65 | 9 |
| | TS9 | 4.2 | 0.9545 | 77 | −3 |
| | TS10 | 5.1 | 0.8793 | 61 | 8 |
| | TS11 | 4.3 | 0.86 | 68 | 10 |
| | TS12 | 4 | 0.9524 | 80 | 4 |
| | TS13 | 4.8 | 0.8571 | 62 | 9 |
| | TS14 | 4.5 | 0.9184 | 60 | 2 |
| | TS15 | 4.1 | 0.9762 | 68 | −7 |
| | TS16 | 5.2 | 0.9123 | 60 | 7 |
| | TS17 | 4.5 | 0.9783 | 60 | 3 |
| | TS18 | 4.2 | 0.9767 | 74 | −1 |
| | TS19 | 5.1 | 0.9623 | 62 | 5 |
| | TS20 | 5.6 | 0.9655 | 58 | 4 |
| | TS21 | 5.2 | 0.9286 | 60 | 8 |
| | TS22 | 4.8 | 0.9796 | 67 | −1 |
| | TS23 | 4.5 | 0.9574 | 63 | 7 |
| | TS24 | 5.1 | 0.8947 | 60 | 1 |
| | TS25 | 5 | 0.9434 | 60 | 7 |
| | TS26 | 5.4 | 0.9818 | 61 | 7 |
| | TS27 | 4.3 | 0.8958 | 65 | −2 |
| | TS28 | 5.2 | 0.9123 | 59 | 9 |
| | TS29 | 5.3 | 0.9138 | 60 | 6 |
| | TS30 | 5.1 | 0.9808 | 57 | 6 |
| | TS31 | 5.7 | 0.9344 | 55 | 2 |
| | TS32 | 5.3 | 0.8833 | 60 | 3 |
| | TS33 | 5.2 | 0.9123 | 58 | 8 |

TABLE 7-continued

| | | Toughness | | | |
|---|---|---|---|---|---|
| | | Charpy impace value at room temperature, kgf-m/cm$^2$ | Charpy impace value ratio | Fracture appearance transition temperature (FATT), ° C. | Δ FATT, ° C. |
| | TS34 | 5.6 | 0.9492 | 60 | 5 |
| | TS35 | 4.9 | 0.9245 | 64 | −1 |
| | TS36 | 4.2 | 0.9130 | 72 | −1 |
| | TS37 | 5 | 0.9615 | 60 | 4 |
| | TS38 | 4.7 | 0.9038 | 62 | 11 |
| | TS39 | 5.4 | 0.8852 | 56 | 6 |
| | TS40 | 4.4 | 0.88 | 59 | 3 |
| | TS41 | 5.2 | 0.9811 | 63 | 0 |
| | TS42 | 5.7 | 0.9344 | 60 | 3 |
| | TS43 | 4.6 | 0.9020 | 64 | 5 |
| | TS44 | 5.8 | 0.9355 | 61 | 8 |
| | TS45 | 5.2 | 0.9630 | 58 | 4 |
| | TS46 | 5.8 | 0.9667 | 60 | 1 |
| | TS47 | 5.5 | 0.9483 | 60 | 4 |
| | TS48 | 4.7 | 0.9038 | 57 | 2 |
| | TS49 | 5.4 | 0.8852 | 63 | 5 |
| | TS50 | 5.2 | 0.8966 | 64 | 10 |
| | TS51 | 5.5 | 0.9649 | 60 | 8 |
| | TS52 | 5.5 | 0.8871 | 65 | 10 |
| | TS53 | 4.6 | 0.9583 | 74 | 14 |
| | TS54 | 4.6 | 1.0222 | 80 | 2 |
| | TS55 | 4.3 | 0.9348 | 65 | 7 |
| | TS56 | 5.6 | 0.9655 | 63 | 8 |
| | TS57 | 4.8 | 0.9231 | 66 | 8 |
| | TS58 | 5.5 | 0.9167 | 60 | 4 |
| | TS59 | 5.6 | 0.9655 | 62 | 2 |
| | TS60 | 4.8 | 0.96 | 60 | −3 |
| | TS61 | 5.2 | 0.9811 | 65 | 0 |
| | TS62 | 4.7 | 0.9216 | 64 | 6 |
| | TS63 | 4.6 | 0.9583 | 58 | −7 |
| | TS64 | 4 | 0.9524 | 77 | 1 |
| | TS65 | 4.2 | 0.9333 | 74 | −4 |
| | TS66 | 4.8 | 0.96 | 81 | −2 |

TS = Test Sample

TABLE 8

| | | Toughness | | | |
|---|---|---|---|---|---|
| | | Charpy impact value at room temperature, kgf-m/cm$^2$ | Charpy impact value ratio | Fracture appearance transition temperature (FATT), ° C. | Δ FATT, ° C. |
| Comparative Example | TS67 | 4.5 | 0.9184 | 63 | 6 |
| | TS68 | 4.7 | 0.9038 | 60 | 5 |
| | TS69 | 4.4 | 0.9362 | 76 | 2 |
| | TS70 | 5.6 | 0.9032 | 64 | 9 |
| | TS71 | 2.3 | 0.5476 | 122 | 44 |
| | TS72 | 2.1 | 0.6176 | 129 | 32 |
| | TS73 | 4.6 | 0.92 | 58 | 3 |
| | TS74 | 2.3 | 0.6765 | 136 | 41 |
| | TS75 | 1.4 | 0.56 | 143 | 40 |

TS = Test Sample

As shown in Table 7 and Table 8, test sample 1 to test sample 66 have a large value of Charpy impact value ratio at room temperature and a small value of ΔFATT in comparison with test sample 71 and test sample 72 (with the Mo content larger than the chemical composition range of the heat resistant cast steel of the embodiment) and test sample 74 and test sample 75 (with the B content larger than the chemical composition range of the heat resistant cast steel of the embodiment). It is seen from the above results that test sample 1 to test sample 66 have small reduction in toughness with age after the isothermal aging treatment in comparison with test sample 71 and test sample 72 and test sample 74 and test sample 75.

As described above, the heat resistant cast steel of the embodiment has a long creep rupture life and also has excellent creep rupture ductility and toughness. And, aging deterioration of the creep rupture life, creep rupture ductility and toughness is small even after the isothermal aging treatment at a high temperature for a long time.

According to the above-described embodiment, it is possible to achieve all of the improvement of long creep rupture life, improvement of creep rupture ductility and toughness, and suppression of aging deterioration after the high temperature long-term operation. Further, according to the embodiment, it is possible to get excellent weldability.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A method of manufacturing a heat resistant cast steel comprising, in percent by mass, C: 0.05-0.15, Si: 0.03-0.2, Mn: 0.1-1.5, Ni: 0.1-1, Cr: 8-8.7, Mo: 0.2-1.5, V: 0.1-0.3, Co: 2.7-5, W: 0.1-5, N: 0.005-0.03, Nb: 0.01-0.2, B: 0.004-0.015, Ti: 0.01-0.1, and Fe, the method comprising:

melting raw materials, refining and degassing the melted raw materials, pouring the melted raw materials into a predetermined mold to form a shape, performing an annealing treatment at a temperature of 1000 to 1150° C., cooling the annealed raw materials at a cooling rate of 20 to 60° C./hour, performing a normalizing treatment at a temperature of 1000 to 1200° C., cooling the normalized raw materials at a cooling rate of 100 to 600° C./hour in a center part of the heat resistant cast steel, performing a first stage tempering treatment at a temperature of 500 to 700° C., cooling the first-stage tempered raw materials at a cooling rate of 40 to 100° C./hour in the center part of the heat resistant cast steel, performing a second stage tempering treatment at a temperature of 700 to 780° C., and cooling the second-stage tempered raw materials at a cooling rate of 20 to 60° C./hour.

2. The method of claim 1, wherein the heat resistant cast steel further comprises, in percent by mass, at least one selected from the group consisting of Ta: 0.01-0.2, Zr: 0.01-0.1 and Re: 0.01-1.5.

3. A method of manufacturing a cast part of a steam turbine, the method comprising:

melting raw materials, refining and degassing the melted raw materials, pouring the melted raw materials into a predetermined mold to form a shape, performing an annealing treatment at a temperature of 1000 to 1150° C., cooling the annealed raw materials at a cooling rate of 20 to 60° C./hour, performing a normalizing treatment at a temperature of 1000 to 1200° C., cooling the normalized raw materials at a cooling rate of 100 to 600° C./hour in a center part of the heat resistant cast steel, performing a first stage tempering treatment at a temperature of 500 to 700° C., cooling the first-stage tempered raw materials at a cooling rate of 40 to 100° C./hour in the center part of the heat resistant cast steel, performing a second stage tempering treatment at a temperature of 700 to 780° C., and cooling the second-stage tempered raw materials at a cooling rate of 20 to 60° C./hour, to obtain a cast part comprising, in percent by mass, C: 0.05-0.15, Si: 0.03-0.2, Mn: 0.1-1.5, Ni: 0.1-1, Cr: 8-8.7, Mo: 0.2-1.5, V: 0.1-0.3, Co: 2.7-5, W: 0.1-5, N: 0.005-0.03, Nb: 0.01-0.2, B: 0.004-0.015, Ti: 0.01-0.1, and Fe.

4. The method of claim 3, wherein the obtained cast part further comprises, in percent by mass, at least one selected from the group consisting of Ta: 0.01-0.2, Zr: 0.01-0.1 and Re: 0.01-1.5.

* * * * *